US007878677B1

(12) United States Patent
Robinson et al.

(10) Patent No.: US 7,878,677 B1
(45) Date of Patent: Feb. 1, 2011

(54) NOVELTY CEILING FIXTURE

(76) Inventors: Steve Robinson, 3435 Artesia Blvd., #1, Torrance, CA (US) 90504; Yvonne Robinson, 3435 Artesia Blvd., #1, Torrance, CA (US) 90504

( * ) Notice: Subject to any disclaimer, the term of this patent is extended or adjusted under 35 U.S.C. 154(b) by 83 days.

(21) Appl. No.: 12/244,936

(22) Filed: Oct. 3, 2008

Related U.S. Application Data

(60) Provisional application No. 60/977,524, filed on Oct. 4, 2007.

(51) Int. Cl.
*F21S 8/00* (2006.01)

(52) U.S. Cl. ..... 362/147; 362/271; 362/287

(58) Field of Classification Search ..... 362/147, 362/148, 150, 269, 271, 272, 286, 287, 366, 362/372, 421
See application file for complete search history.

(56) References Cited

U.S. PATENT DOCUMENTS 6,779,908 B1 * 8/2004 Ng ..... 362/147

* cited by examiner

*Primary Examiner*—John A Ward
(74) *Attorney, Agent, or Firm*—Kenneth L. Tolar

(57) ABSTRACT

A novelty ceiling fixture includes a housing mounted within a ceiling having a hub depending therefrom. The hub is formed of two independently rotating segments each having an angled, truncated end adjoining the other. Attached to the lower segment is a fixture configured to resemble a skateboard mounted on wheels. Each wheel includes a translucent or transparent outer surface superimposed on a plurality of peripherally-disposed LED'S. A remote unit controls the operation of the LEDs and hub segments so that the fixture simulates the movement of a conventional skateboard.

7 Claims, 3 Drawing Sheets

NOVELTY CEILING FIXTURE

CROSS REFERENCE TO RELATED APPLICATIONS

This application is entitled to the benefit of provisional application No. 60/977,524 filed on Oct. 4, 2007, the specification of which is incorporated herein by reference.

BACKGROUND OF THE INVENTION

The present invention relates to a novelty ceiling fixture that resembles a moving skateboard.

DESCRIPTION OF THE PRIOR ART

Skateboard enthusiasts often decorate a bedroom or other areas with various skateboarding memorabilia, such as posters, pictures and similar mundane ornamentation. However, there is currently a need for a more unique and creative means of adorning a skateboard enthusiast's room. The present invention addresses this need by providing a ceiling fixture that resembles a moving skateboard.

SUMMARY OF THE INVENTION

A novelty ceiling fixture includes a housing mounted within a ceiling having a hub depending therefrom. The hub is formed of two independently rotating segments each having an angled, truncated end adjoining the other. Attached to the lower segment is a fixture configured to resemble a skateboard mounted on wheels. Each wheel includes a translucent or transparent outer surface superimposed on a plurality of peripherally disposed LED'S. A remote unit controls the operation of the LED's and hub segments so that the fixture simulates the movement of a conventional skateboard.

It is therefore an object of the present invention to provide a ceiling fixture that resembles a skateboard.

It is another object of the present invention to provide a ceiling fixture that simulates skateboard movement.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
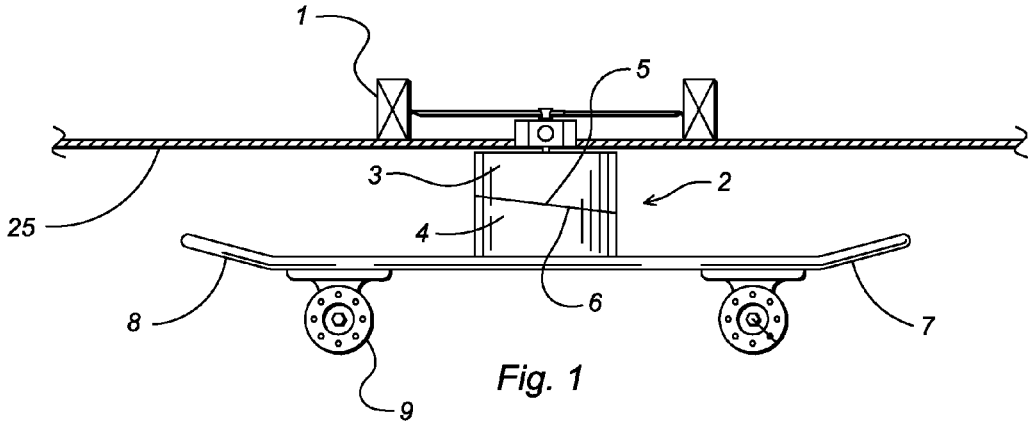
FIG. 1 is a side, plan view of the fixture mounted within a ceiling.
Figure 2:
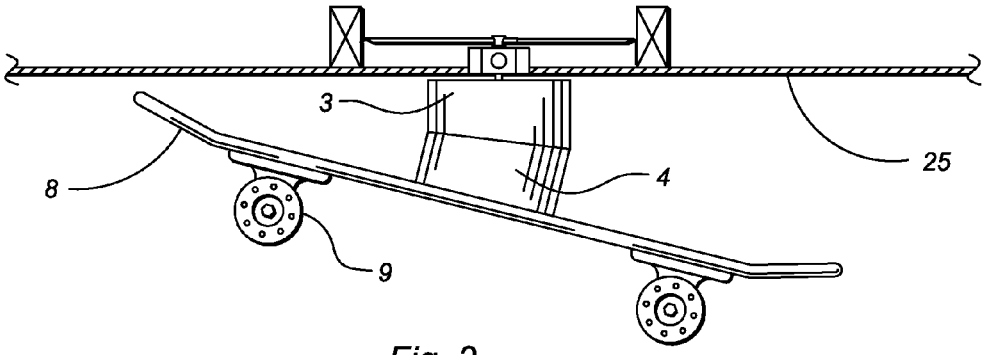
FIG. 2 is a side, plan view of the fixture tilted in a first direction.
Figure 3:
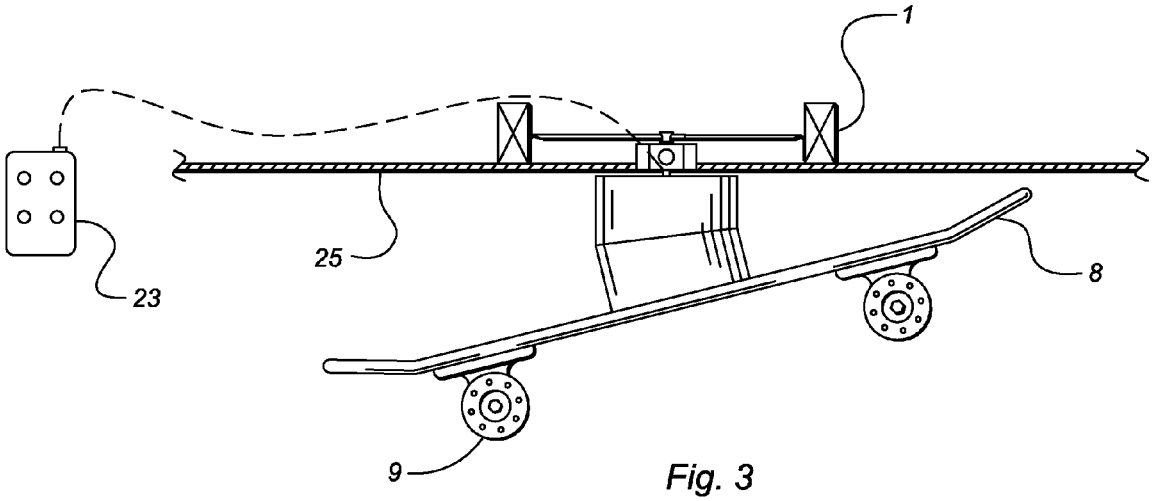
FIG. 3 is a side, plan view of the fixture tilted in a direction opposite that of FIG. 2.
Figure 4:
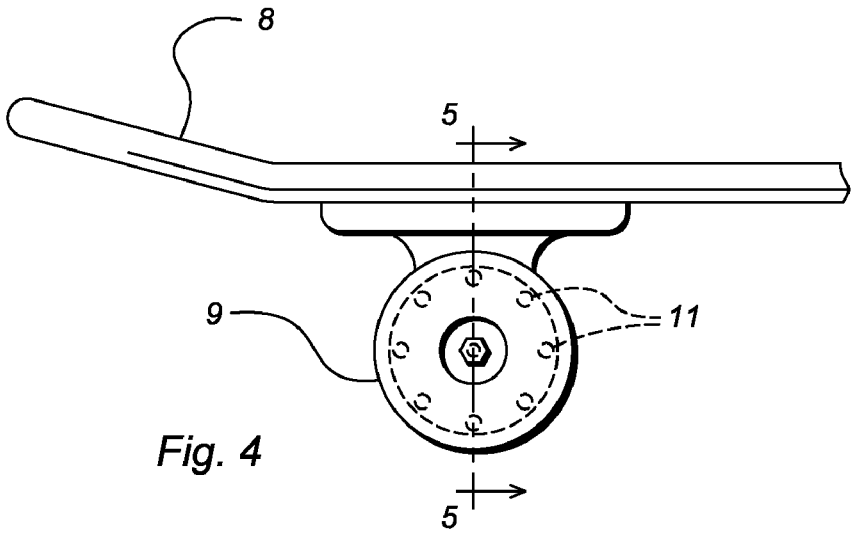
FIG. 4 is a detailed view of a lighted wheel.
Figure 5:
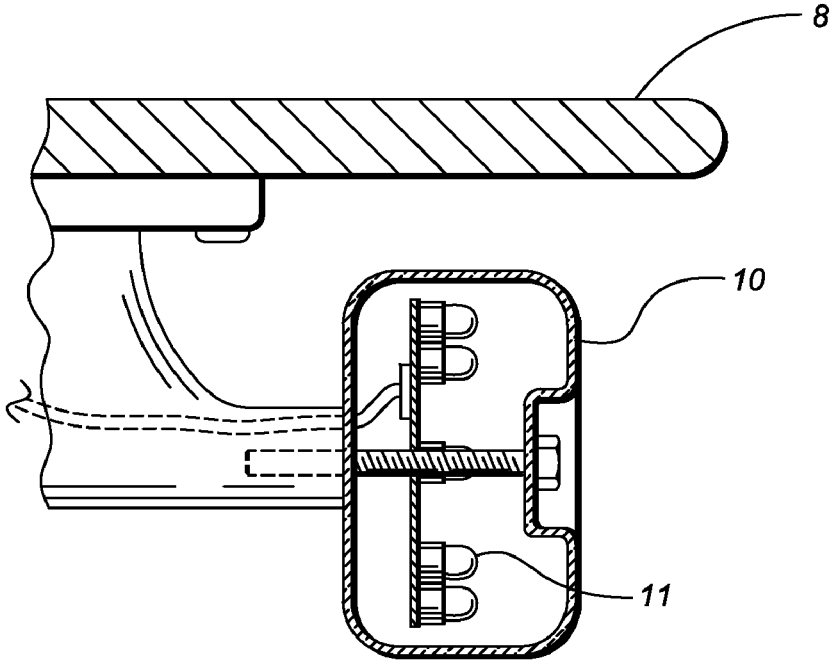
FIG. 5 is a side, cross sectional view of a lighted wheel.
Figure 6:
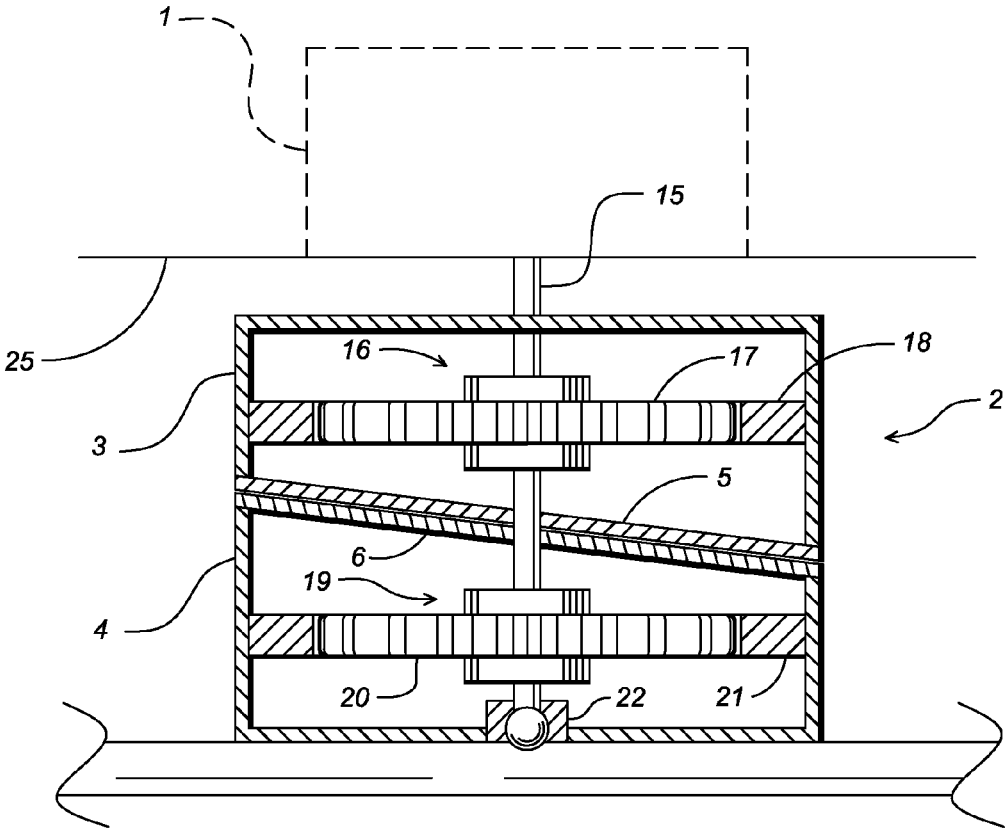
FIG. 6 is a cross-sectional view of the hub assembly and internal motors.

The present invention relates to a novelty ceiling fixture. The device comprises a housing 1 mounted within a ceiling 25 in a conventional fashion. Depending from the housing is a hub assembly 2 formed of an upper segment 3 and a lower segment 4. The upper hub segment includes a lower end 5 that is obliquely truncated relative to the hub's longitudinal axis.

The lower segment likewise includes an upper end 6 that is truncated at the same angle relative to the hub's longitudinal axis.

A fixed shaft 15 extends from the housing through each of the hub segments and includes a pair of motors mounted thereon. An upper motor 16 is positioned within the upper hub segment and includes a geared rotor 17 or similar mechanism that engages a circumferential geared track 18 on the interior surface of the upper segment. Likewise, a lower motor 19 is positioned within the lower hub segment and includes a geared rotor 20 or similar mechanism that engages a circumferential geared track 21 on the interior surface of the lower segment. Accordingly, as the hub segments rotate independently, the lower segment continuously moves between various angles relative to the upper segment.

Depending from the lower hub segment is a fixture 7 configured to resemble a skateboard 8 mounted on wheels 9. A lower end of the fixed shaft is attached to the upper surface of the fixture with a ball joint 22 that allows the fixture to tilt in various directions as the hub segments rotate. Each wheel includes a transparent or translucent (frosted polypropylene plastic) outer face 10 superimposed on a plurality of peripherally disposed LED'S 11. Preferably, the outer face is detachable to allow access to the LED'S and associated wiring.

The motors and LED'S are controlled with a small, handheld remote 23 and are powered by the building's main power supply. The LED'S can be operated in one of three modes: 1) the LED'S sequentially pulse to simulate slow wheel motion; 2) the LED'S sequentially pulse more rapidly to simulate faster wheel motion; or, 3) all LED'S are continuously illuminated. The controller also allows a user to operate the motors independently or simultaneously. When the hub segments are operating independently, the truncated, contiguous ends cause the lower hub segment and, thus the skateboard, to reciprocate thereby simulating skateboard travel.

The above-described device is not limited to the exact details of construction and enumeration of parts provided herein. For example, the fixture may be mounted on a longer shaft similar to a ceiling fan to properly suspend the fixture from a vaulted or a raised ceiling. A projector may be placed on the upper surface of the skateboard to project images that simulate the skateboard moving along the ceiling. Though the fixture is primarily depicted and described as being a skateboard, it could resemble virtually any desired object. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A novelty ceiling fixture comprising:

a housing mounted within a ceiling;

a hub assembly depending from the housing, said hub assembly formed of an upper segment and a lower segment, said upper segment having an obliquely truncated lower end, said lower segment having an obliquely truncated upper end that engages the lower end of said upper segment;

a fixture member depending from the lower segment;

means for independently and automatically rotating said upper segment and said lower segment so that said lower segment continuously moves between various angles relative to the upper segment, causing said fixture to simulate travel.

2. The novelty ceiling fixture according to claim 1 wherein said means for independently and automatically rotating said upper segment and said lower segment comprises:

an upper motor positioned within the upper hub segment, said upper motor having a geared rotor that engages a circumferential geared track on an interior surface of the upper segment;

a lower motor positioned within the lower hub segment, said lower motor including a geared rotor that engages a circumferential geared track on an interior surface of the lower segment whereby operation of either of said upper motor and said lower motor causes the lower segment to continuously move between various angles relative to the upper segment.

3. The novelty ceiling fixture according to claim 2 wherein said fixture member is configured to resemble a skateboard mounted on a plurality of wheels.

4. The novelty ceiling fixture according to claim 3 wherein each of said wheels includes a translucent outer face superimposed on a plurality of peripherally-disposed LED'S.

5. The novelty ceiling fixture according to claim 4 further comprising means for sequentially pulsing said LED'S at a first predetermined speed to simulate slow wheel motion.

6. The novelty ceiling fixture according to claim 5 further comprising means for sequentially pulsing said LED'S at a second predetermined speed that is faster than said first predetermined speed to simulate fast wheel motion.

7. The novelty ceiling fixture according to claim 6 further comprising means for continuously illuminating said LED'S.

* * * * *